United States Patent [19]

Camm et al.

[11] Patent Number: 4,605,380

[45] Date of Patent: Aug. 12, 1986

[54] HEARTBEAT DOLL

[75] Inventors: Samuel A. Camm, 966 Ponus Ridge Rd., New Canaan, Conn. 06840; Malcolm E. Bryant, Easton, Conn.

[73] Assignee: Samuel A. Camm, New Cannan, Conn.

[21] Appl. No.: 711,371

[22] Filed: Mar. 13, 1985

[51] Int. Cl.[4] ..... A63H 33/00; A63H 3/00

[52] U.S. Cl. ..... 446/14; 446/295

[58] Field of Search ..... 446/295, 472, 302, 130, 446/484, 485, 418, 303, 297, 14

[56] References Cited

U.S. PATENT DOCUMENTS

| | | | |
|---|---|---|---|
| 3,014,312 | 12/1961 | Convertine | 446/295 |
| 3,119,200 | 1/1964 | Curtin et al. | 446/295 X |
| 3,162,980 | 12/1964 | Hellman | 446/302 |
| 3,184,886 | 5/1965 | Weih | 446/295 |
| 3,224,139 | 12/1965 | Reuge | 446/295 |
| 3,232,004 | 2/1966 | Felsher | 446/130 |
| 3,298,132 | 1/1967 | Elwell | 446/295 |
| 4,166,337 | 9/1979 | Kosicki et al. | 446/295 |

*Primary Examiner*—Mickey Yu

*Attorney, Agent, or Firm*—Arthur L. Lessler

[57] ABSTRACT

A doll having a cavity adjacent an inner chest wall of the doll. A solenoid within the cavity is repetitively actuated by a pulse generator within the doll to cause the plunger of the solenoid to strike the inner chest wall, causing sound and vibration which simulate a heartbeat. In another embodiment, a temperature sensor is mounted on a surface portion of the doll to control the pulse rate of the pulse generator.

6 Claims, 4 Drawing Figures

HEARTBEAT DOLL

BACKGROUND OF THE INVENTION

This invention relates to a doll having a heartbeat which can be felt by touching or holding the doll.

A doll with such a heartbeat is suitable for use as a toy for children, and as an aid in teaching children.

A doll is known which is sold with a toy stethoscope, with a heartbeat sound simulator built into the stethoscope, so that when the child uses the stethoscope on the doll, the child hears a heartbeat. However, since the doll itself does not have a heartbeat, the child cannot directly feel or hear a heartbeat in the doll.

Accordingly, an object of the present invention is to provide a doll having an internal heartbeat operated by a self-contained mechanism, so that the heartbeat can be felt by touching or holding the doll.

SUMMARY OF THE INVENTION

As herein described, there is provided a heartbeat doll having an internal cavity adjacent an inner wall of the doll. The doll has impact force generating means disposed within the internal cavity and having an impact member for repetitively impacting the inner wall of the doll when the impact force generating means is repetitively actuated. Pulse generator means disposed within the doll repetitively actuates the impact force generating means.

IN THE DRAWING

DETAILED DESCRIPTION

Figure 1:
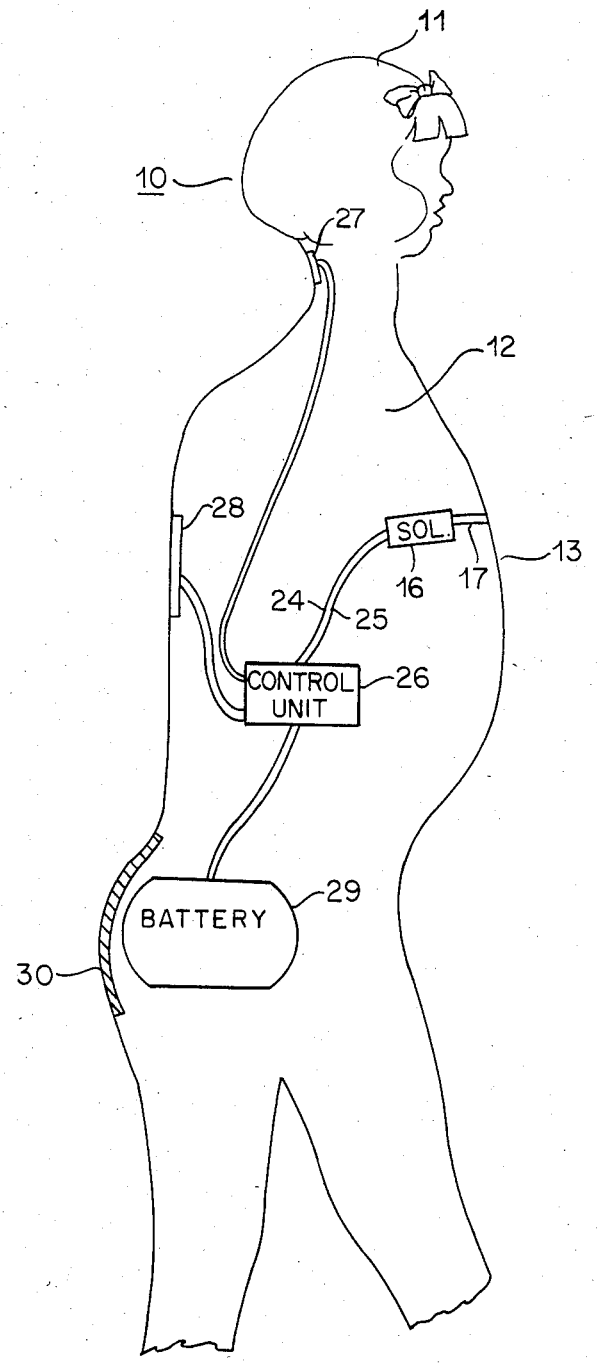
FIG. 1 is a side elevation pictorial view showing the interior of the body of a doll having a heartbeat according to the present invention.
Figure 3:
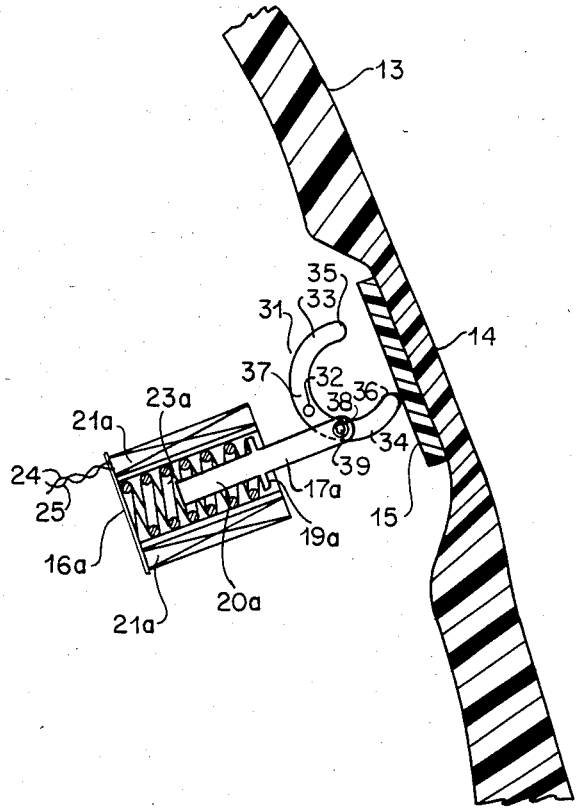
FIG. 3 is a partial cross-sectional view showing a portion of the chest wall of the doll and the adjacent heartbeat-generating solenoid arrangement, according to a second embodiment of the invention.
Figure 2:
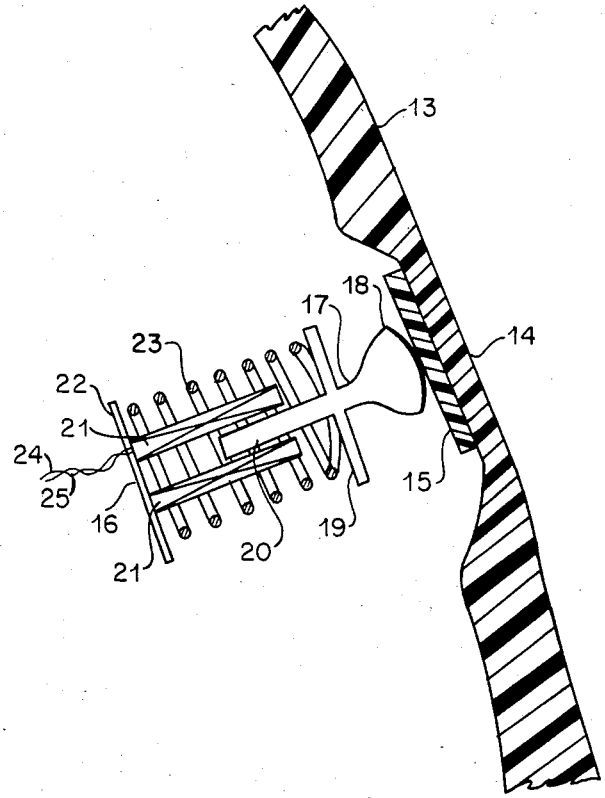
FIG. 2 is a partial cross-sectional view showing a portion of the chest wall of the doll and the adjacent heartbeat-generating solenoid arrangement, according to a first embodiment of the invention.

As shown in FIG. 1, a doll 10 has hollow head and body cavities 11 and 12 respectively, and a chest wall 13. As best seen in FIGS. 2 and 3, a portion 14 of the chest wall 13 has a thickness less than that of the adjacent portions of the chest wall, to facilitate the transmission of sound and vibration through this portion of the wall. The reduced thickness chest wall portion 14 is preferably situated where the heart of the doll would be expected to be.

The wall of the doll is preferably made of a thermoplastic material such as polyethylene or polypropylene, or of a synthetic rubber.

As also seen in FIGS. 2 and 3, a relatively rigid (as compared with the rigidity of the chest wall portions 13 and 14) sounding board or plate 15 is secured to or formed integrally with the inner surface of the reduced thickness chest wall portion 14. The plate 15 is preferably formed of a relatively rigid plastic material such as acrylonitrile-butadiene-styrene (ABS), or may alternatively be formed of hardboard, wood or metal.

Disposed within the body cavity 12 adjacent the portion of the inner chest wall comprising the sounding board or plate 15, is a solenoid 16 having a plunger 17 for repetitively impacting the sounding board or plate 15.

As best seen in FIG. 2, the plunger 17 has an enlarged head 18 for striking the board or plate 15, a flange 19, and a rod portion 20 made of a magnetically permeable material.

As also seen in FIG. 2, the solenoid 16 has an electromagnetic coil 21, from which leads 24 and 25 extend, and a bottom flange 22. A spring 23 extends between the flanges 19 and 22 to urge the solenoid end 18 against the sounding board or plate 15.

When the solenoid 16 is repetitively actuated by electrical pulses applied to the leads 24 and 25 from the control unit 26 (FIG. 1), the plunger 17 is alternately drawn into the solenoid 16 by magnetic force and pushed away from the solenoid 16 by the spring 23, causing the enlarged end 18 to repetitively strike the board or plate 15, thus generating noise and vibration simulating a heartbeat of the doll 10.

A switch 27 turns the control unit 26 on and off to turn the doll's heartbeat on and off. The switch 27 is situated at the back of the neck of the doll and may comprise a manually actuable membrane, pushbutton or slide switch.

Alternatively, the switch 27 may comprise a position-sensitive switch such as a mercury switch or a suitably mounted magnetic reed switch, set so that the switch is off and the doll therefore has no heartbeat when the doll is horizontal; and the switch is on and the doll has a heartbeat when the doll is picked up or otherwise moved to a non-horizontal position.

The rate at which the heartbeat is simulated corresponds to the pulse repetition rate of the solenoid actuating pulses generated by the control until 26, which rate may be varied by variation of the resistance of the temperature sensitive plate 28. The plate 28 is disposed on the external surface of the back of the doll 10, and may comprise a thin film thermistor or other temperature sensitive resistance means, the resistance of which preferably decreases with increasing temperature, so that when the doll is held with the hand of the holder on the plate 28, the resulting increase in temperature causes the "heartbeat" of the doll to increase.

Alternatively, instead of the plate 28 a manually controllable resistor may be provided to vary the rate of the doll's "heartbeat".

Power for the control unit 26 is supplied by a battery 29, access to which is obtained by a removable hatch 30 corresponding to the "rear end" of the doll.

Figure 4:
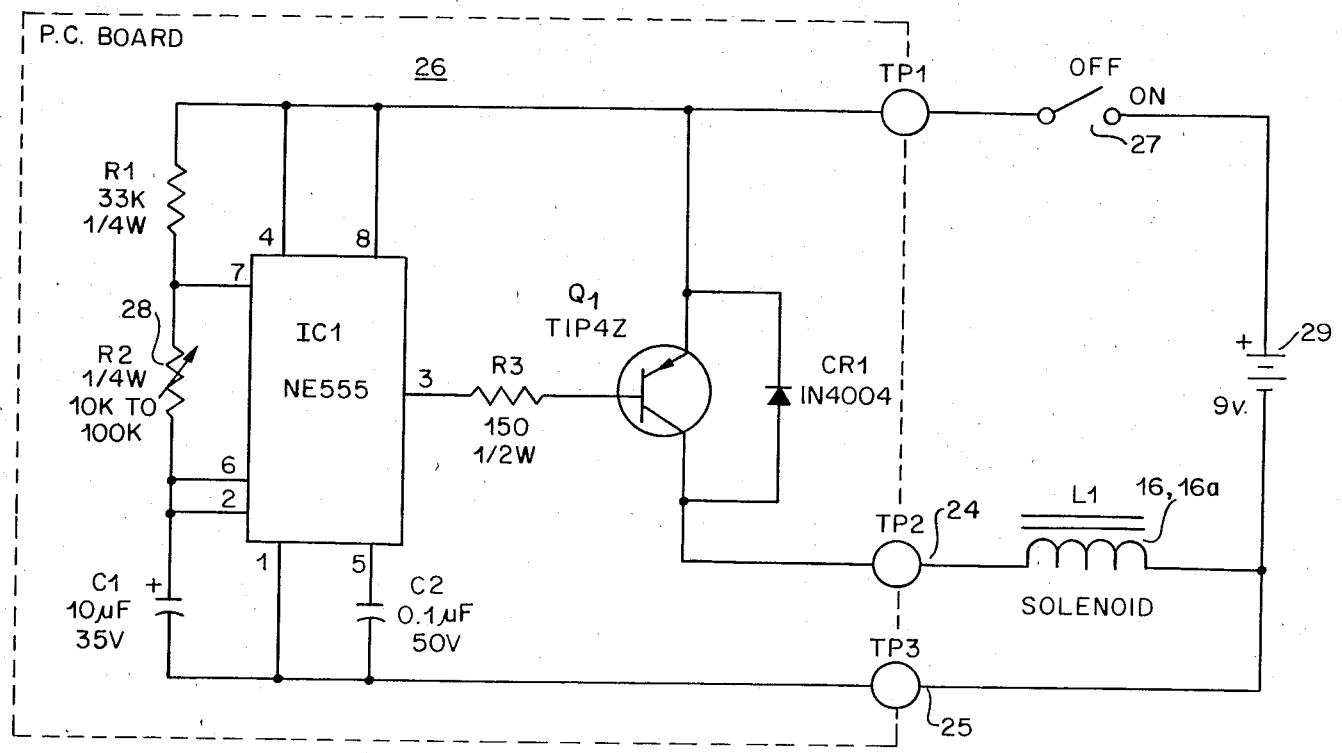
FIG. 4 is a schematic diagram of the heartbeat-generating circuitry within the doll.

The circuit of the control unit 26, and its connections to the solenoid 16, switch 27, plate 28 and battery 29, are shown in the schematic diagram of FIG. 4.

As seen in FIG. 4, the integrated circuit IC1 is a type NE555 timing circuit and, in conjunction with the associated circuit elements R1, R2 (28), C1 and C2, acts as an astable multivibrator. The multivibrator preferably has a pulse repetition rate in the range of 40 to 120 pulses per minute. When the value of resistance R2 is 47,000 ohms the pulse repetition rate is about 68 pulses per minute.

The output pulses from the multivibrator appear on line 3 of IC1, and are coupled to the base of PNP driver transistor Q1 via resistor R3. The emitter and collector of transistor Q1 are connected in series with the electromagnetic coil of solenoid 16, so that the solenoid is actuated in synchronism with the signal on output line 3 of the integrated circuit.

Diode CR1 protects driver transistor Q1 against damage due to reverse voltage that might be developed due to rapid current changes within the coil of the solenoid 16.

The notations TP1, TP2 and TP3 in FIG. 4 refer to test points which are also the points of connection of the control unit 26 to the solenoid 16, on-off switch 27, and battery 29.

The solenoid-and-plunger arrangement generates only one "heartbeat" for each output pulse of the control unit 26, since the hammer 18 strikes the sounding board or plate 15 when the current in the electromagnetic coil 21 is terminated (due to the action of the spring 23), but does not strike the board or plate 15 when the electromagnetic coil 21 is actuated. However, the noise and vibration accompanying the movement of the solenoid plunger and adjacent portion of the wall of the doll generate a "secondary heartbeat" when the coil 21 is deactuated, causing the doll to feel and sound like it has a two-step irregular heartbeat.

It is therefore desirable to have similar "heartbeats" generated both when the electromagnetic coil of the solenoid is actuated and when it is deactuated, so that the doll appears to have a "regular heartbeat".

FIG. 4 shows an alternative solenoid-and-plunger configuration which generates two similar "heartbeats" for each output pulse of the control unit 26.

In the solenoid 16*a* of FIG. 3, the electromagnetic coil 21*a* has an internal spring 23*a* which extends between the bottom internal wall of the solenoid 16*a* and a flange 19*a* extending from the rod portion 20*a* of the plunger 17*a*.

A generally U-shaped hammer member 31 has side legs 33 and and 34 with free ends 35 and 36 respectively which serve as hammer ends to impact the sounding board or plate 15; and a center leg 37 mounted for rotary reciprocation about a pivot 32.

The free end of the plunger rod 20*a* has a hole 38 which pivotally engages a pin 39 extending from the side leg 34 of the generally U-shaped member 31, so that as the rod 20*a* reciprocates toward and away from the solenoid coil 21*a*, the hammer ends 35 and 36 alternately strike the sounding board or plate 15.

When the electromagnetic coil 21*a* is actuated, the rod 20*a* of the plunger 17*a* is drawn toward the coil, causing the hammer end 35 to strike the sounding board or plate 15, and when the electromagnetic coil 21*a* is deactuated, the spring 23*a* moves the rod 20*a* in the opposite direction, causing the hammer end 36 to strike the sounding board or plate 15, thus providing the doll with a more "regular" heartbeat.

We claim:

1. A heartbeat doll having an internal cavity adjacent an inner chest wall of the doll, said doll comprising:
   - solenoid means disposed within said cavity, said solenoid means comprising a solenoid having a plunger for repetitively impacting said inner chest wall when the solenoid is repetitively actuated;
   - spring means for biasing said plunger in a given position with respect to said inner chest wall when said solenoid is not actuated;
   - pulse generator means disposed within said doll for repetitively actuating said solenoid; and
   - means comprising a temperature sensor mounted on a surface portion of said doll for varying the pulse repetition rate of said pulse generator means.

2. A heartbeat doll having an internal cavity adjacent an inner wall of the doll, said doll comprising:
   - sounding means secured to or integral with said inner wall;
   - solenoid means disposed within said cavity, said solenoid means comprising a solenoid having a plunger for repetitively impacting said sounding means when the solenoid is repetitively actuated;
   - spring means for biasing said plunger in a given position with respect to said inner wall when said solenoid is not actuated;
   - pulse generator means disposed within said doll for repetitively actuating said solenoid;
   - switching means within said doll for turning the pulse generator means on and off; and
   - means comprising a temperature sensor mounted on a surface portion of said doll for varying the pulse repetition rate of said pulse generator means.

3. A heartbeat doll having an internal cavity adjacent an inner chest wall of the doll, said doll comprising:
   - solenoid means disposed within said cavity, said solenoid means comprising a solenoid having a plunger comprising a generally U-shaped hammer for repetitively impacting said inner chest wall when said solenoid is repetitively actuated, and a plunger rod,
   - said hammer being mounted for reciprocation about a pivot coupled to the center leg of the hammer,
   - said plunger rod being coupled to one of the side legs of the hammer;
   - spring means for biasing said plunger in a given position with respect to said inner chest wall when said solenoid is not actuated; and
   - pulse generator means disposed within said doll for repetitively actuating said solenoid,
   - said plunger rod causing the hammer to reciprocate about the pivot, so that the free ends of the side legs of the hammer alternately impact the inner chest wall of the doll when the solenoid is repetitively actuated and deactuated.

4. A heartbeat doll having an internal cavity adjacent an inner wall of the doll, said doll comprising:
   - sounding means secured to or integral with said inner wall;
   - solenoid means disposed within said cavity, said solenoid means comprising a solenoid having a plunger comprising a generally U-shaped hammer for repetitively impacting said sounding means when said solenoid is repetitively actuated, and a plunger rod,
   - said hammer being mounted for reciprocation about a pivot coupled to the center leg of the hammer,
   - said plunger rod being coupled to one of the side legs of the hammer;
   - spring means for biasing said plunger in a given position with respect to said inner wall when said solenoid is not actuated;
   - pulse generator means disposed within said doll for repetitively actuating said solenoid; and
   - switching means within said doll for turning the pulse generator means on and off,
   - said plunger rod causing the hammer to reciprocate about the pivot, so that the free ends of the side legs of the hammer alternately impact the sounding means when the solenoid is repetitively actuated and deactuated.

5. A heartbeat doll having an internal cavity adjacent an inner chest wall of the doll, said doll comprising:

solenoid means disposed within said cavity, said solenoid means comprising a solenoid having a plunger and a hammer connected to said plunger for repetitively impacting said inner chest wall when said solenoid is repetitively actuated;

spring means for biasing said plunger in a given position with respect to said inner chest wall when said solenoid is not actuated; and pulse generator means disposed within said doll for repetitively actuating said solenoid, said solenoid means being adapted to cause said hammer to impact said inner chest wall each time said solenoid is actuated and each time the actuation of said solenoid is terminated.

6. A heartbeat doll having an internal cavity adjacent an inner wall of the doll, said doll comprising:

sounding means secured to or integral with said inner wall;

solenoid means disposed within said cavity, said solenoid means comprising a solenoid having a plunger and a hammer connected to said plunger for respectively impacting said sounding means when said solenoid is repetitively actuated;

spring means for biasing said plunger in a given position with respect to said inner wall when said solenoid is not actuated;

pulse generator means disposed within said doll for repetitively actuating said solenoid; and switching means within said doll for turning the pulse generator means on and off, said solenoid means being adapted to cause said hammer to impact said sounding means each time said solenoid is actuated and each time the actuation of said solenoid is terminated.

* * * * *